United States Patent [19]

Mattsson

[11] Patent Number: 4,557,193

[45] Date of Patent: Dec. 10, 1985

[54] PRINTING DEVICE

[75] Inventor: Sten I. Mattsson, Mörrum, Sweden

[73] Assignee: Facit Aktiebolag, Atvidaberg, Sweden

[21] Appl. No.: 414,377

[22] PCT Filed: Jan. 15, 1982

[86] PCT No.: PCT/SE82/00012

§ 371 Date: Aug. 27, 1982

§ 102(e) Date: Aug. 27, 1982

[87] PCT Pub. No.: WO82/02516

PCT Pub. Date: Aug. 5, 1982

[30] Foreign Application Priority Data

Jan. 19, 1981 [SE] Sweden ..... 8100272

[51] Int. Cl.[4] ..... B41J 9/04

[52] U.S. Cl. ..... 101/93.48; 101/93.34; 400/157.2; 335/263

[58] Field of Search ..... 400/157.2, 167, 686, 400/687; 101/93.02, 93.29, 93.04, 93.34, 93.48; 335/263, 257, 271, 277, 240, 262, 255; 251/55, 48, 129; 188/316; 16/84

[56] References Cited

U.S. PATENT DOCUMENTS

| | | | |
|---|---|---|---|
| 269,151 | 12/1882 | Woolley | 335/255 X |
| 2,295,068 | 9/1942 | Woodin | 335/255 |
| 2,792,779 | 5/1957 | Toeppen et al. | 400/389 X |
| 4,308,794 | 1/1982 | Adamoli et al. | 101/93.48 X |

FOREIGN PATENT DOCUMENTS

| | | | |
|---|---|---|---|
| 2839024 | 3/1979 | Fed. Rep. of Germany | 400/157.2 |

*Primary Examiner*—Edgar S. Burr
*Assistant Examiner*—Charles A. Pearson
*Attorney, Agent, or Firm*—Burns, Doane, Swecker & Mathis

[57] ABSTRACT

In a printing device for printers or typewriters a hammer (11) is axially movable between a print position and a rest position. At one end the hammer has an impact surface (12) which acts upon a selected one of a number of type characters disposed along the periphery of a type disc. Preferably at its front end the hammer (11) is connected to a long guide pin (26) which extends mainly perpendicular to the length direction of the hammer and cooperates with a guide slot (27) that extends in the length direction of the hammer. The guide slot is situated at a distance from the hammer which is considerably greater than the diameter of the hammer in its connection point with the guide pin (26). Preferably, the distance is at least four times the diameter.

4 Claims, 2 Drawing Figures

PRINTING DEVICE

Figure 2:
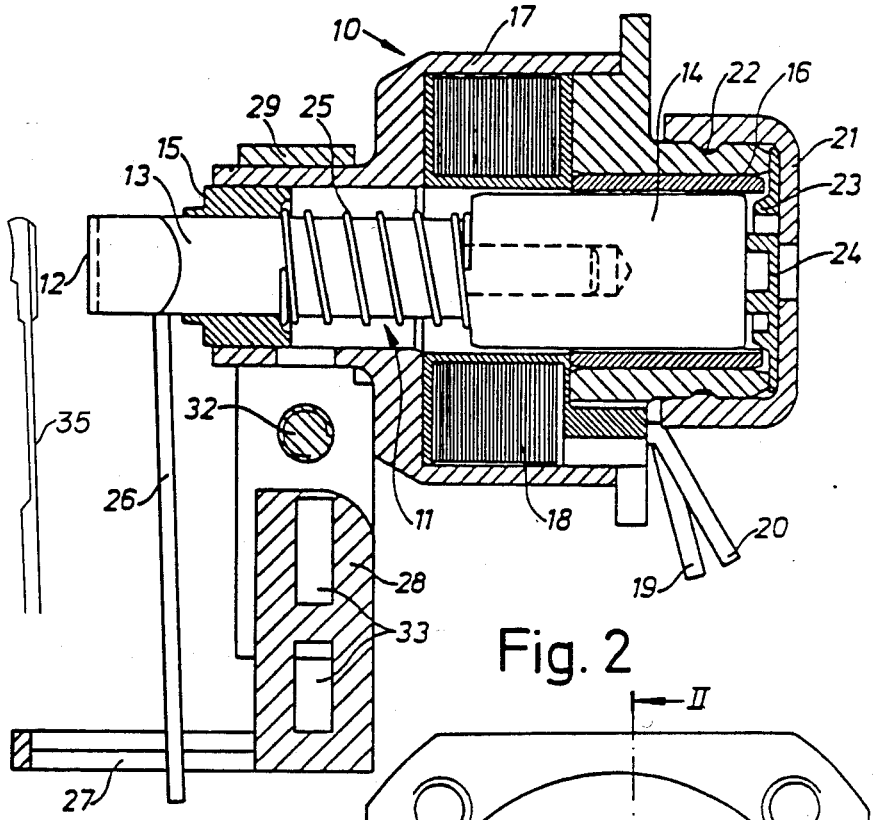

The present invention refers to a printing device for use in printers and typewriters and of the kind having an axially translatable elongate cylindrical hammer with an impact surface which acts upon a type character. Rotation of the hammer is prevented by a guide pin disposed in a guide slot extending in the direction of translation of the hammer. The guide pin is mounted on the hammer or in a housing in which the hammer translates, and the guide slot is provided in the other of the hammer and the housing.

A printing device of the kind referred to comprises, preferably, a type carrier in the shape of a type disc which is rotatably mounted for the selection of a desired one of a number of type characters disposed along the disc periphery. The type disc cooperates with a hammer which preferably is driven electromagnetically. The easiest way of making the hammer is by using a circular rod. This shape, however, involves the possibility for the hammer to turn around its length axis which in certain cases may unfavourably influence the appearance of the print on a document made by the printing device.

In typewriters having a printing device comprising a type disc it has been suggested to have the hammer center the type at impact. For this purpose the hammer can be provided with an impact surface in the shape of a wedge-type recess which cooperates with a similarly shaped projection on the back of each type. The described shape of the impact surface and of the types causes the type at impact to be forced into a print position determined by the hammer.

If in a printing device having impact centered types as described above the hammer should turn slightly around its length axis, also the impact surface of the hammer will turn. Accordingly, the type at impact will turn correspondingly and the character will be obliquely reproduced on a recording medium. It may be noted that a turning of the hammer through an angle of about ½ degree will result in an oblique reproduction of the character that is detectable by the human eye.

In order to guide the hammer and thereby to reduce the undesired turning the hammer can be provided with a longitudinal slot in which engages a fixedly mounted guide pin.

However, the slot and the guide pin have to be carefully dimensioned so that on one hand the possible turning is minimized while on the other hand the inevitable friction between the cooperating guide parts are kept within reasonable bounds. The demand for narrow tolerances in a printing device of this kind calls for frequent replacement of the hammer and/or the guide pin due to wear.

Another way of preventing rotation is to give the hammer and the parts surrounding it a section that differs from the cylindrical shape. For instance, the hammer along part of its length may have a half-circular section and may be journalled in a similarly shaped slide bearing. Here a certain amount of play between the bearing and the hammer has to be accepted in order for the hammer to move under low friction. The said play may cause a turning of the hammer that equals ½ degree or is even greater. Hence, the printed characters will be obliquely reproduced in an unacceptable way. Moreover, the asymmetric hammer and bearing shape requires additional machining which increases the production costs.

The object of the invention is to overcome the drawbacks indicated above and to provide a printing device of the kind referred to in which a hammer of cylindrical shape has been provided with a guiding device that reduces the maximal turning of the hammer to a value far below the above limit of ½ degree. Moreover, the guiding device according to the invention operates mainly without any friction that might influence the movement of the hammer.

The object is achieved in a printing device having the features stated in the appended claims.

Figure 1:
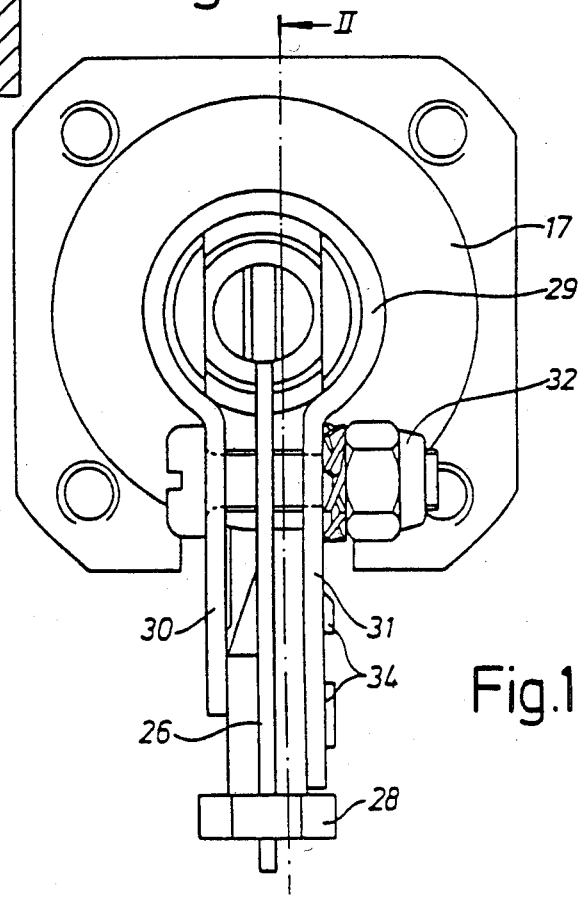

The invention will now be described in detail with reference to the accompanying drawing in which:

FIG. 1 is a front elevation of a print hammer in accordance with the invention; and FIG. 2 is a section along the line II—II in FIG. 1.

A hammer device is generally characterized by the reference numeral 10. The device comprises a hammer 11 having an impact surface 12 which cooperates with a selected type character of a type disc 35. The hammer 11 comprises a front part 13 which is non-magnetic and fixedly connected to a back part 14 of magnetic material. The parts 13 and 14 both have a cylindrical section and are journalled in a front slide bearing 15 and a back slide bearing 16, respectively. The bearings have been pressed into holes provided in a housing 17 which also encloses a coil 18 which when activated generates a magnetic field that drives the hammer 11 to the left in the Figure towards the print position. The electrical connection of the coil is made via two terminals 19,20 provided in the housing 17. The rear portion of the housing is closed by a cover 21 which is secured to the housing by a snap fastening arrangement 22 comprising a ringshaped bulge and a correspondingly shaped groove provided in the housing. A plastic part 23 is jammed between the cover 21 and the housing 17 and has a valve disc 24 being part of an air damping arrangement for the hammer. A spring 25 biasses the hammer 11 away from the print position into engagement with a stop constituted by the valve disc 24.

The front end of part 13 is connected to an extended guide pin 26 which cooperates with a guide slot 27 provided in a plastic piece 28 secured to the housing 17 by means of a metal clip 29 which encloses the front part of the housing 17. Like the hammer this front part of the housing 17 has a cylindrical section. The metal clip 29 has two legs 30,31 which are kept together by a screw joint 32. The leg 31 is provided with a recess 33 in which engage projections 34 provided on the plastic detail 28. Upon tightening of the screw joint the metal clip 29 is fixed to the housing 17 and the plastic piece 28 is fixed to the metal clip.

Due to the fact that the guide pin engages the guide slot at a point situated at a relatively great distance from the hammer the necessary play between the guide pin and the guide slot results in a turning of the hammer that is considerably smaller than in prior art printing devices. By suitable selection of the position of engagement of the guide pin with the guide slot the resulting turning of the hammer may be kept at a negligible value and the corresponding oblique reproduction of the character will not be detectable by the human eye. The distance from the point of connection of the guide pin to the guide slot should be at least greater than the diameter of the hammer at this point of connection, and is preferably at least four times greater than the diameter of the hammer.

I claim:

1. A printing device, comprising:

a housing;

an elongate cylindrical hammer that is axially translatable in said housing, said hammer having an impact surface at one end thereof;

a movable type carrier having a plurality of type characters each of which selectively cooperates with said impact surface to be centered thereby when said hammer engages said type carrier; and means for preventing rotation of said hammer relative to said housing, including a guide pin mounted on said hammer adjacent said one end and extending generally perpendicular from said hammer, and a guide slot extending parallel to the direction of translation of said hammer and being provided in said housing at a radial distance from said hammer that is greater than the diameter of said hammer at the point where said guide pin is mounted thereon, said guide pin being disposed within said guide slot.

2. A printing device, comprising:

a housing;

an elongate cylindrical hammer that is axially translatable in said housng, said hammer having an impact surface at one end thereof;

a movable type carrier having a plurality of type characters each of which selectively cooperates with said impact surface to be centered thereby when said hammer engages said type carrier; and means for preventing rotation of said hammer relative to said housing, including a guide pin mounted on said hammer adjacent said one end and extending generally perpendicular from said hammer, and a guide slot extending parallel to the direction of translation of said hammer and being provided in said housing at a radial distance from said hammer that is at least four times greater than the diameter of said hammer at the point where said guide pin in mounted thereon, said guide pin being disposed within said guide slot.

3. The printing device of claim 1 wherein said housing is generally cylindrical in shape and has a reduced diameter portion adjacent said one end of said hammer, and further including a metal clip which surrounds said reduced diameter portion and which has a pair of legs extending therefrom, and a plastic member disposed between said legs, said plastic member having said guide slot provided therein.

4. The printing device of claim 2 wherein said housing is generally cylindrical in shape and has a reduced diameter portion adjacent said one end of said hammer, and further including a metal clip which surrounds said reduced diameter portions and which has a pair of legs extending therefrom, and a plastic member disposed between said legs, said plastic member having said guide slot provided therein.

* * * * *